US012702890B1

(12) United States Patent
Tyree

(10) Patent No.: US 12,702,890 B1
(45) Date of Patent: Aug. 11, 2026

(54) LEVER ARM-INCLINED PLANE-WHEEL/AXLE-INERTIAL/FRICTIONAL RESISTANCE-GRAVITATIONAL EXERCISE APPARATUS

(71) Applicant: Timothy D Tyree, Phoenix, AZ (US)

(72) Inventor: Timothy D Tyree, Phoenix, AZ (US)

( * ) Notice: Subject to any disclaimer, the term of this patent is extended or adjusted under 35 U.S.C. 154(b) by 931 days.

(21) Appl. No.: 15/998,046

(22) Filed: Jun. 18, 2018

Related U.S. Application Data

(60) Provisional application No. 62/707,778, filed on Nov. 16, 2017.

(51) Int. Cl.
*A63B 21/08* (2006.01)
*A63B 21/06* (2006.01)
*A63B 21/16* (2006.01)

(52) U.S. Cl.
CPC ..... *A63B 21/0616* (2015.10); *A63B 21/16* (2013.01)

(58) Field of Classification Search
CPC ... A63B 21/00; A63B 21/0004; A63B 21/012; A63B 22/00; A63B 26/00; A63B 21/06
See application file for complete search history.

(56) References Cited

U.S. PATENT DOCUMENTS 3,256,015 A * 6/1966 Perrin ..... A63B 21/04 24/129 C
3,751,031 A * 8/1973 Yamauchi ..... A63B 21/065 273/DIG. 19
3,953,024 A * 4/1976 Brubacher ..... B63B 35/73 440/100
3,972,238 A * 8/1976 Thatcher ..... A61B 5/224 434/251
4,618,142 A * 10/1986 Joseph, Jr. ..... A63B 5/20 482/106
4,854,578 A * 8/1989 Fulks ..... A63B 21/00072 482/100
5,417,635 A * 5/1995 Sell ..... A63B 21/0605 482/105
5,531,657 A * 7/1996 Macedo ..... A63B 21/0084 482/106
5,653,665 A * 8/1997 Neeley ..... A63B 21/0552 482/106
5,788,612 A * 8/1998 Rennick ..... A63B 69/208 482/83
6,612,971 B1 * 9/2003 Morris ..... A63B 23/047 473/441
D505,459 S * 5/2005 Lagattuta ..... D21/680
6,942,585 B1 * 9/2005 Krause ..... A63B 69/002 473/441
7,322,905 B2 * 1/2008 Morris ..... A63B 23/047 482/118
D579,990 S * 11/2008 Dalcourt ..... D21/662
8,109,863 B2 * 2/2012 Gilberti ..... A63B 21/0603 473/438
8,231,511 B2 * 7/2012 Dalcourt ..... A63B 21/0607 482/106
8,360,938 B2 * 1/2013 Gilman ..... A63B 21/0615 482/51

(Continued)

*Primary Examiner* — Garrett K Atkinson
(74) *Attorney, Agent, or Firm* — TOD R. NISSLE, P.C.

(57) ABSTRACT

Exercise apparatus includes a tire and support apparatus. The support apparatus includes a pair of inclined support surfaces. A pair of wheels is rotatably mounted on the tire such that when the tire is turned over the wheels engage and roll down the inclined support surfaces.

1 Claim, 10 Drawing Sheets

(56) References Cited

U.S. PATENT DOCUMENTS 8,622,878 B2 * 1/2014 Abelbeck ..... A63B 21/0724 482/93
8,651,972 B2 * 2/2014 Hoeschler ..... A63B 22/16 446/153
9,144,704 B1 * 9/2015 Abelbeck ..... A63B 21/08
9,717,941 B2 * 8/2017 Gagnon ..... A63B 21/4023
2003/0224914 A1 * 12/2003 De Montesquieux ..... A63B 21/0552 482/148
2004/0002408 A1 * 1/2004 Rigas ..... A63B 5/20 482/82
2006/0116256 A1 * 6/2006 Carney ..... A63B 21/0724 482/106
2006/0264300 A1 * 11/2006 Chen ..... A63B 21/072 482/14
2007/0249472 A1 * 10/2007 Frei ..... A45B 1/02 482/66
2007/0287609 A1 * 12/2007 McBride ..... A63B 21/065 482/105
2010/0285934 A1 * 11/2010 Abelbeck ..... A63B 21/00072 482/97
2012/0149535 A1 * 6/2012 Abelbeck ..... A63B 21/0724 482/93
2013/0095984 A1 * 4/2013 Agate ..... A63B 21/0618 482/106
2013/0130814 A1 * 5/2013 Hoeschler ..... A63B 22/16 472/127
2014/0145407 A1 * 5/2014 Chen ..... B62B 1/22 280/47.12
2015/0126344 A1 * 5/2015 Wehrell ..... A63B 23/047 482/128
2015/0165258 A1 * 6/2015 Januszek ..... A63B 21/06 482/93
2016/0361584 A1 * 12/2016 Towley ..... A63B 21/06
2016/0361585 A1 * 12/2016 Gagnon ..... A63B 21/4023
2017/0014668 A1 * 1/2017 Haddad ..... A63B 21/4035
2017/0266486 A1 * 9/2017 Anderson ..... A63B 21/4049
2017/0296858 A1 * 10/2017 Towley ..... A63B 21/06
2018/0015318 A1 * 1/2018 Nelson ..... A63B 21/0601

* cited by examiner

LEVER ARM-INCLINED PLANE-WHEEL/AXLE-INERTIAL/FRICTIONAL RESISTANCE-GRAVITATIONAL EXERCISE APPARATUS

This application claims priority based on provisional patent application Ser. No. 62/707,778, filed Nov. 16, 2017, and on patent application Ser. No. 14/545,419, filed May 1, 2015, which claims priority based on provisional patent application Ser. No. 61/998,628 filed Jul. 3, 2014.

This application relates to exercise apparatus.

More particularly, the application relates to exercise apparatus which utilizes the ground as a component of the apparatus and, in particular, utilizes the ground both as fulcrum and to generate a resistance force.

Those of skill in the art have long focused on providing improved exercise apparatus.

It would be highly desirable to provide improved exercise apparatus.

Accordingly, it is a principal objective of the invention to provide improved exercise apparatus.

This, and other and further objects of the invention will be apparent to those skilled in the art from the following detailed description thereof, taken in conjunction with the drawings, in which.

Figure 1:
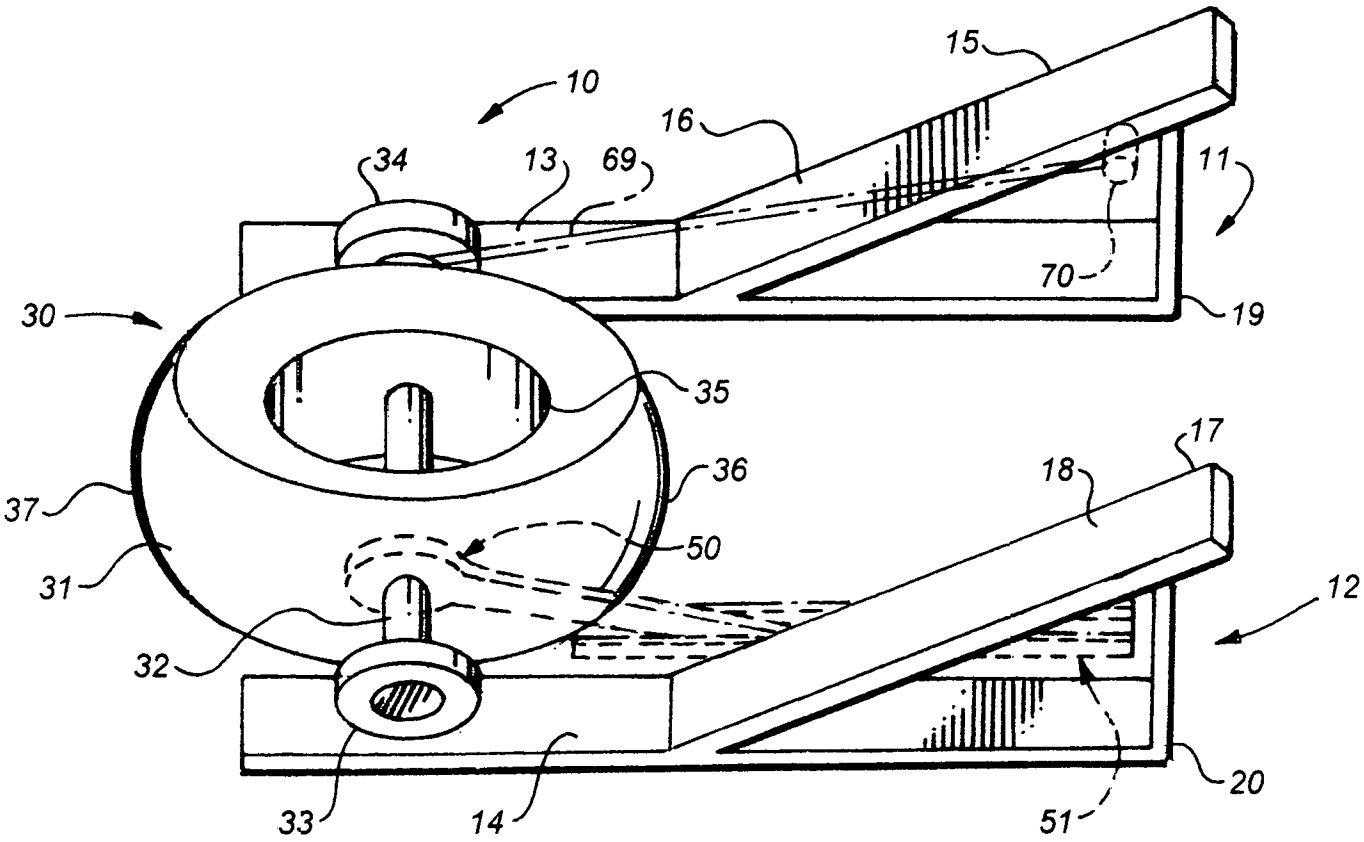
FIG. 1 is a perspective view illustrating exercise apparatus constructed in accordance with the invention.

Briefly, in accordance with the invention, I provide improved exercise apparatus. The apparatus comprises a tire having an outer diameter; and, support apparatus contacting and upwardly depending from the ground. The support apparatus comprises a generally horizontally oriented base contacting the ground, and at least a pair of support surfaces each laying in a common inclined plane, connected to and upwardly extending from the base, and spaced apart a selected distance greater than the diameter of said tire. The support apparatus and the ground have a support apparatus-ground interface. The exercise apparatus also comprises an axle extending through the tire and including first and second ends each located exterior of an opposite side of the tire. The first and second ends are spaced apart a distance greater than the diameter of the tire. The exercise apparatus also includes a pair of wheels each rotatably mounted on a different one of the first and second ends. The exercise apparatus is shaped and dimensioned such that the tire is movable between at least three operative positions, a first operative position in which the tire is generally horizontally oriented with respect to the ground; a second operative position in which a first side of said tire is upwardly displaced from the first operative position as a lever arm to pivot a second opposing side of the tire about a fulcrum comprising the ground, in which the wheels are spaced apart from the base and the support surfaces, and in which the tire is canted in a first direction; and, a third operative position in which the tire is canted in a second direction opposite the first direction, the second opposing side of the tire frictionally contacts the ground, each of the wheels contacts a different one of the support surfaces, and the force of gravity acting on the tire generates a horizontal vector component having a magnitude sufficient to overcome the frictional contact between said second opposing side and the ground, sufficient for the second opposing side to slide over the ground, and sufficient for the wheels to roll down the support surfaces. The support apparatus-ground interface secures the base in fixed position on the ground while the second opposing side slides over the ground.

In an alternate embodiment provided is an exercise machine including a tire; a base; a pair of rods pivotally attached to either side of the tire; a pair of vertically extending rails each pivotally attached to and extending between the base and the rods; a support structure; and, a support spring interconnecting the tire and the support structure.

In a further embodiment of the invention, provided is an improved exercise apparatus. The apparatus comprises a tire having an outer diameter and first and second opposed sides; and, a support apparatus. The support apparatus contacts and upwardly depends from the ground. The support apparatus comprises a generally horizontally oriented base contacting the ground; and, first and second arms pivotally connected to and upwardly extending from said base, spaced apart a selected distance greater than the diameter of the tire; and, each having first and second ends. The support apparatus also comprises a third arm with a first end pivotally connected to the first end of the first arm, and a second end pivotally connected to the first side of the tire. The support apparatus also comprises a fourth arm with a first end pivotally connected to the first end of the second arm, and a second end pivotally connected to the second side of the tire. The support apparatus and the ground having a support apparatus-ground interface. The support apparatus is shaped and dimensioned such that the tire is movable between at least first, second, and third operative positions.

In the first operative position the third arm is generally vertically oriented; and, the first arm is canted with the first end of the first arm spaced apart from and positioned above the tire; and, with the second end of the first arm positioned below the first end of the third arm and first end of the first arm. In the first operative position, the tire is generally horizontally oriented with respect to the ground; positioned between the third and fourth arms; positioned at an elevation beneath the first and second arms; and, not positioned between the first and second arms.

In the second operative position the first arm pivots upwardly to a first generally vertical orientation; and the third and fourth arms move upwardly to a first generally vertical orientation. In the second operative position, the tire is canted in a first direction and generally vertically oriented with respect to the ground; pivoted about a fulcrum comprising the ground; positioned between the third and fourth arms; positioned forwardly from the first and second arms; and not positioned between the first and second arms.

In the third operative position the first and second arms pivot to a second generally vertical orientation; the third and fourth arms pivot between the first and second arms to a second generally vertical orientation; and, the tire is canted in a second direction opposite the first direction, is generally vertically oriented with respect to the ground, is positioned between the third and fourth arms, and is positioned between the first and second arms.

Turning now to the drawings, in which like reference characters refer to corresponding elements throughout the several views and which are provided by way of example and not limitation of the invention, the exercise apparatus of FIG. 1 is generally indicated by reference character 10 and includes a tire apparatus 30 including tire 31 having an outer diameter and an inner opening 35 formed therethrough. The inner opening ordinarily includes, in conventional fashion, a bead (not depicted), and is shaped and dimensioned to be mounted on a rim (not shown). A tire 31 mounted on a rim can be utilized in the practice of the invention, but the use of a rim is not presently preferred.

Support apparatus contacts and upwardly depends from the ground 40 (FIG. 2) and includes a generally horizontally oriented base contacting the ground, and at least a pair of support surfaces 16, 18 each laying in a common inclined plane, connected to and upwardly extending from the base, and spaced apart a selected distance greater than the diameter of the tire. The base includes elongate spaced apart horizontally oriented ground contacting members 13 and 14. Members 13 and 14 and the ground form a support apparatus-ground interface.

Tire apparatus 30 includes axle 32 extending through tire 31. Axle 32 includes first and second ends each located exterior of an opposite side of the tire. The first and second ends are spaced apart a distance greater than the diameter of the tire 31. A pair of wheels 33, 34 are each rotatably mounted on a different one of the first and second ends of axle 32.

The exercise apparatus of FIG. 1 is shaped and dimensioned such that tire 31 and apparatus 30 are movable between at least three operative positions, namely: (a) a first operative position in which tire 31 is generally horizontally oriented with respect to the ground (illustrated in FIGS. 1 and 4); (b) a second operative position in which a first side of tire 31 is upwardly displaced from the first operative position as a lever arm to pivot a second opposing side of tire 31 about a fulcrum comprising the ground 40, in which wheels 33, 34 are spaced apart from base 13, 14 and support surfaces 16, 18, and in which tire 31 is canted in a first direction (illustrated in FIG. 2); and, a third operative position in which tire 31 is canted in a second direction opposite the first direction, in which the second opposing side of tire 31 frictionally contacts the ground, in which each of wheels 33, 34 contacts a different one of support surfaces 16, 18, and, in which the force of gravity G acts on tire 31 to generate a vertical vector component Y and a horizontal vector component, X (illustrated in FIG. 3). The horizontal vector component X has a magnitude sufficient to overcome the frictional contact between the second opposing side 36 and the ground 40, sufficient for the second opposing side 36 to slide over the ground 40, and sufficient for wheels 33 and 34 to roll down the support surface. The support apparatus-ground interface secures base 13,14 in fixed position on the ground 40 while second opposing side 36 slides over the ground 40. The magnitude of vector component X preferably is sufficient to cause tire apparatus 30 to roll down surfaces 16, 18 and return to a starting position comparable to that illustrated in FIG. 1 or FIG. 4. In FIG. 1, tire 31 is resting on the ground. In FIG. 4, tire 31 is parallel to and spaced above the ground 40.

Surface 16 is formed on inclined ramp 15. Ramp 15 is connected to and extends upwardly from base member 13. Vertically oriented support leg 19 interconnects member 13 and ramp 15.

Surface 18 is formed on inclined ramp 17. Ramp 17 is connected to and extends upwardly from base member 14. Vertically oriented support leg 20 interconnects member 14 and ramp 17.

In FIG. 1, members 13 and 14 are spaced apart such that tire 31 contacts, as described above, the ground during operation of the apparatus. If members 13 and 14 are interconnected and, for sake of example, the base comprises one or more large pieces of plywood such that during operation of the apparatus of the invention tire 31 contacts the plywood and does not directly contact the ground, then such plywood is, for the purpose of the present invention, held to comprise the "ground". Similarly, by way of example and not limitation, the "ground" can comprise the grassy or artificial turf found on a baseball or football field, can comprise a floor, can comprises a concrete driveway, etc.

Figure 3:
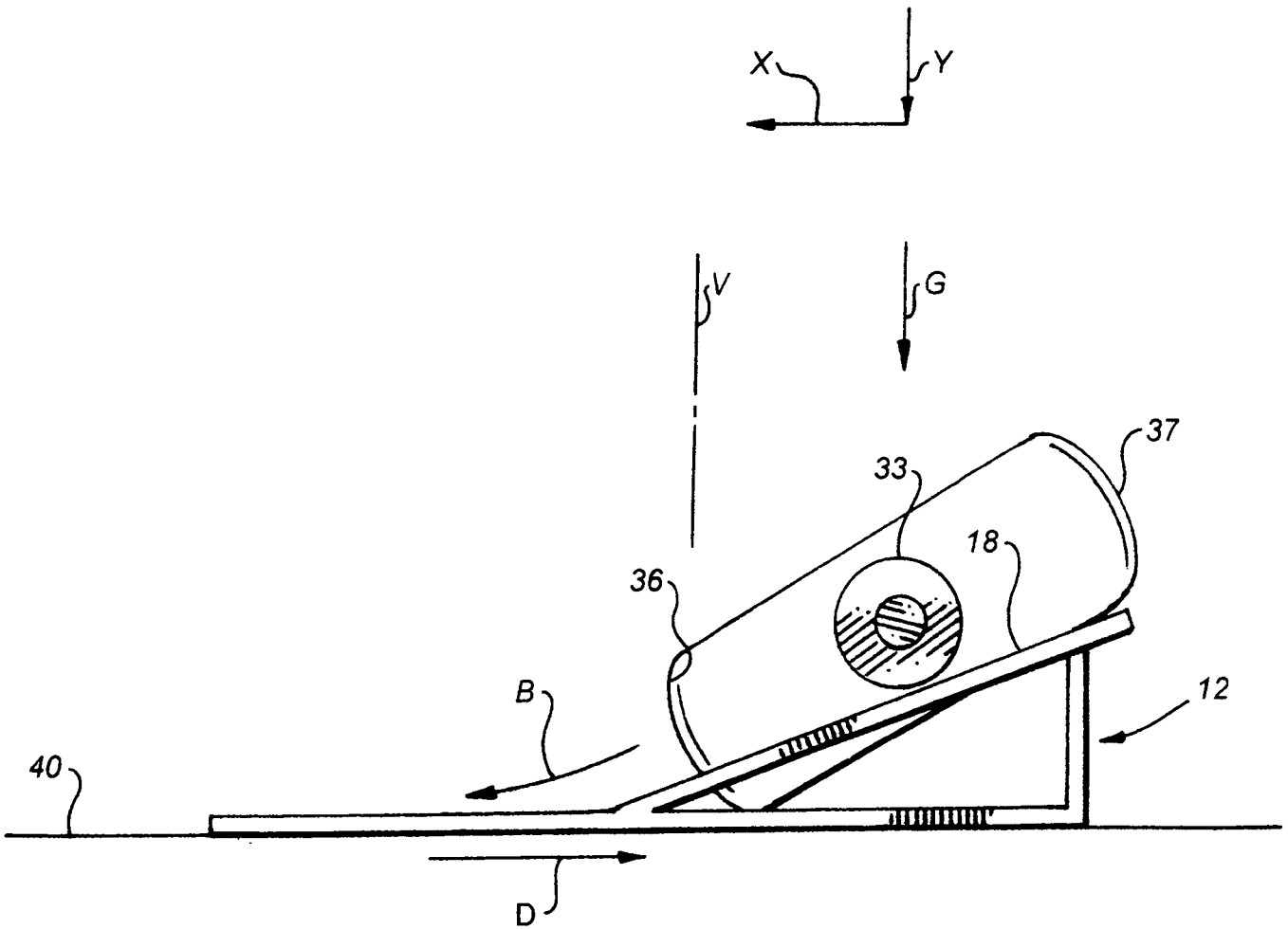
FIG. 3 is a side elevation view further illustrating the mode of operation of the exercise apparatus of FIG. 1.
Figure 4:
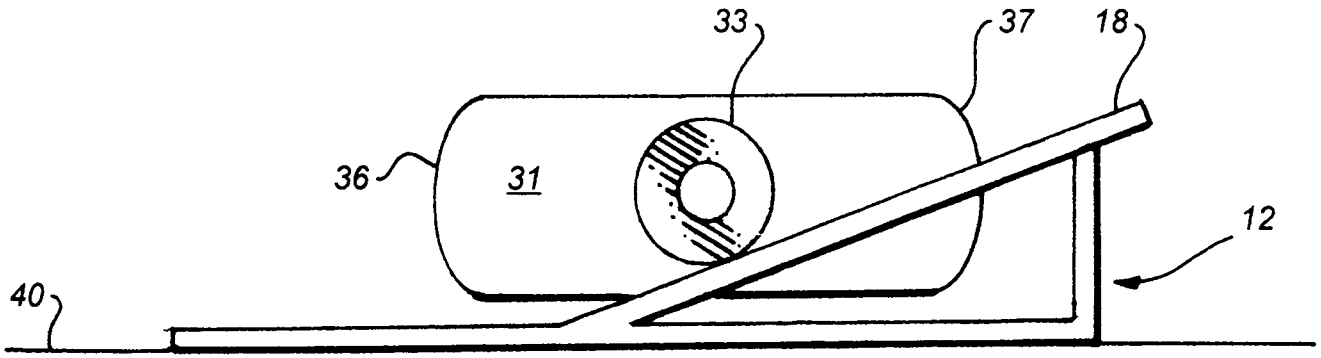
FIG. 4 is a side elevation view further illustrating the mode of operation of the exercise apparatus of FIG. 1.

The gradient, or slope, of surfaces 16 and 18 can vary as desired, but in one embodiment of the invention is preferably sufficient for the force of gravity, when tire apparatus 30 is in the orientation illustrated in FIG. 3, to produce a vector component X sufficient to cause apparatus 30 to overcome frictional forces between side 36 and ground 40, and, to roll down surfaces 16 and 18 to a position comparable to that illustrated in FIG. 1 or FIG. 4.

Figure 8:
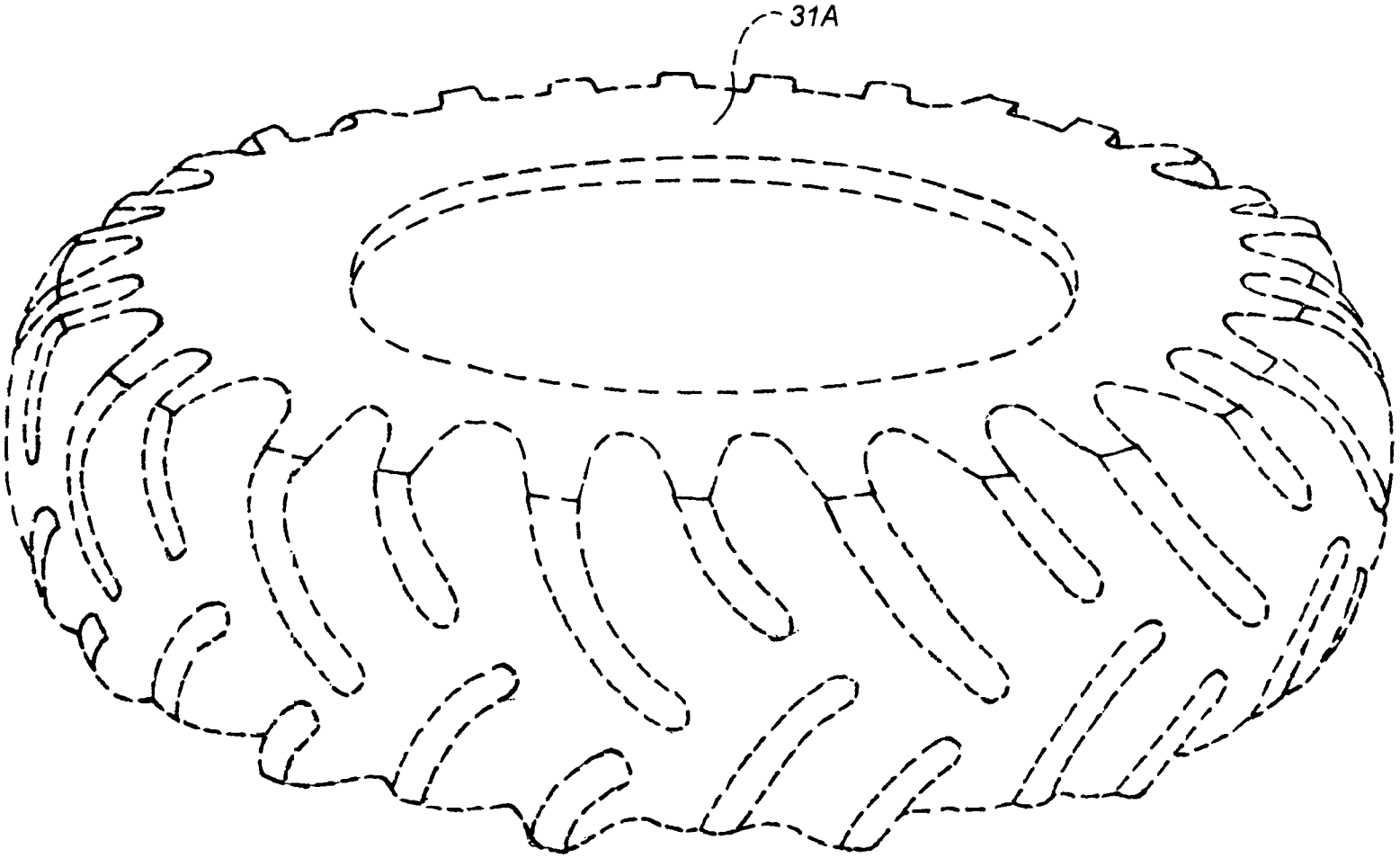
FIG. 8 is a perspective view in ghost outline of a heavy equipment tire which can be utilized in the practice of the invention.

The size of tire 31 can vary as desired, but currently tire 31 has a diameter in the range of three to seven feet. The exercise apparatus of the invention is intended to be usable by a single individual who lifts up a side 37 and pushes the tire up to and through the orientation of FIG. 2 to the position shown in FIG. 3. Once the tire reaches the position illustrated in FIG. 3 and wheels 33 and 34 contact surfaces 18 and 16, respectively, then the force of gravity causes apparatus 30 to "automatically" roll back down surfaces 16 and 18 to a position comparable to that shown in FIG. 1. It is certainly possible that two or more individuals could lift a tire 31 along a side 37, but when a single individual (or even two or more individuals) is lifting a tire 31, at some point the size of a tire can become impractically large. While heavy equipment tires 31A of the general type illustrated in FIG. 8 are presently preferred in the practice of the invention, and while as noted the size of a tire 31 can vary as desired, it is believed that practically speaking a tire with a diameter larger than seven feet would be difficult to utilize. Similarly, if the diameter of tire 31 is too small, the benefits for an adult begin to diminish. While it is certainly possible that a tire having a diameter of less than three feet could be utilized, possibly for apparatus constructed for a child, such is not presently preferred in the practice of the invention.

Figure 7:
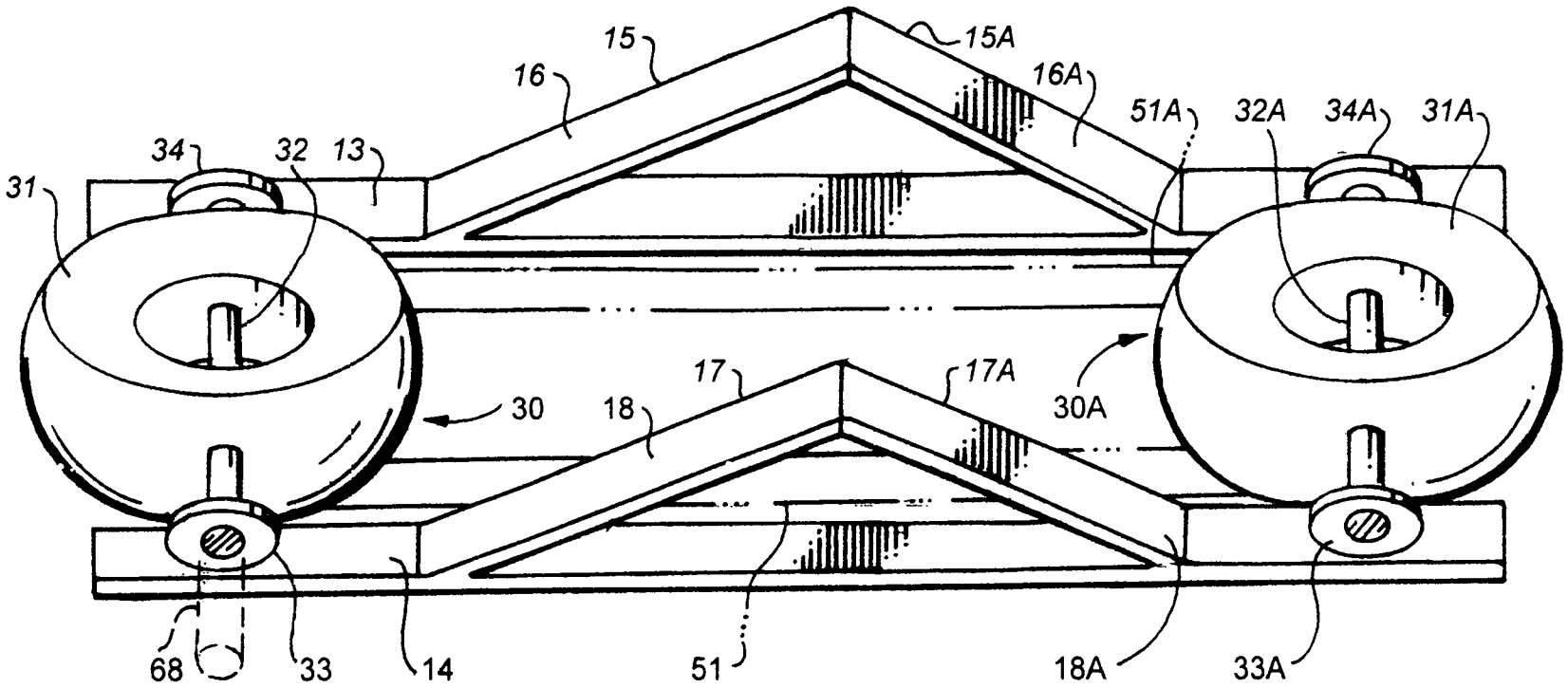
FIG. 7 is a perspective view illustrating another embodiment of the exercise apparatus of the invention.

As shown in FIG. 7, axle 32 can be extended 68 so that weights can be mounted on extension 68. As would be appreciated by those of skill in the art, provisions can be made to mount weights at any desired point on tire 31 or other parts of the apparatus of FIG. 1 in order to increase the amount of resistance that has to be overcome to move tire 31 from the position illustrated in FIG. 1 (or FIG. 4) to the position shown in FIG. 3. Similarly, one end of a tensioned elastic band 69 can be secured to axle 32 and the other to a pin 70 fixedly secured to member 15. Band 69 helps move tire 31 from the position shown in FIG. 1 to the position shown in FIG. 3, and, consequently, reduces the amount of exertion required for an individual to move tire 31 from the position shown in FIG. 1 to the position shown in FIG. 3. As would be appreciated by those of skill in the art, provisions can be made to mount tensioned elastic bands (or tensioned springs or compressed springs which help to push up axle 32 or arms 50, etc.) at any desired points on the apparatus of FIG. 1 in order to reduce the amount of exertion required for an individual to move tire 31 from the position shown in FIG. 1 (or FIG. 4) to the position shown in FIG. 3.

Figure 2:
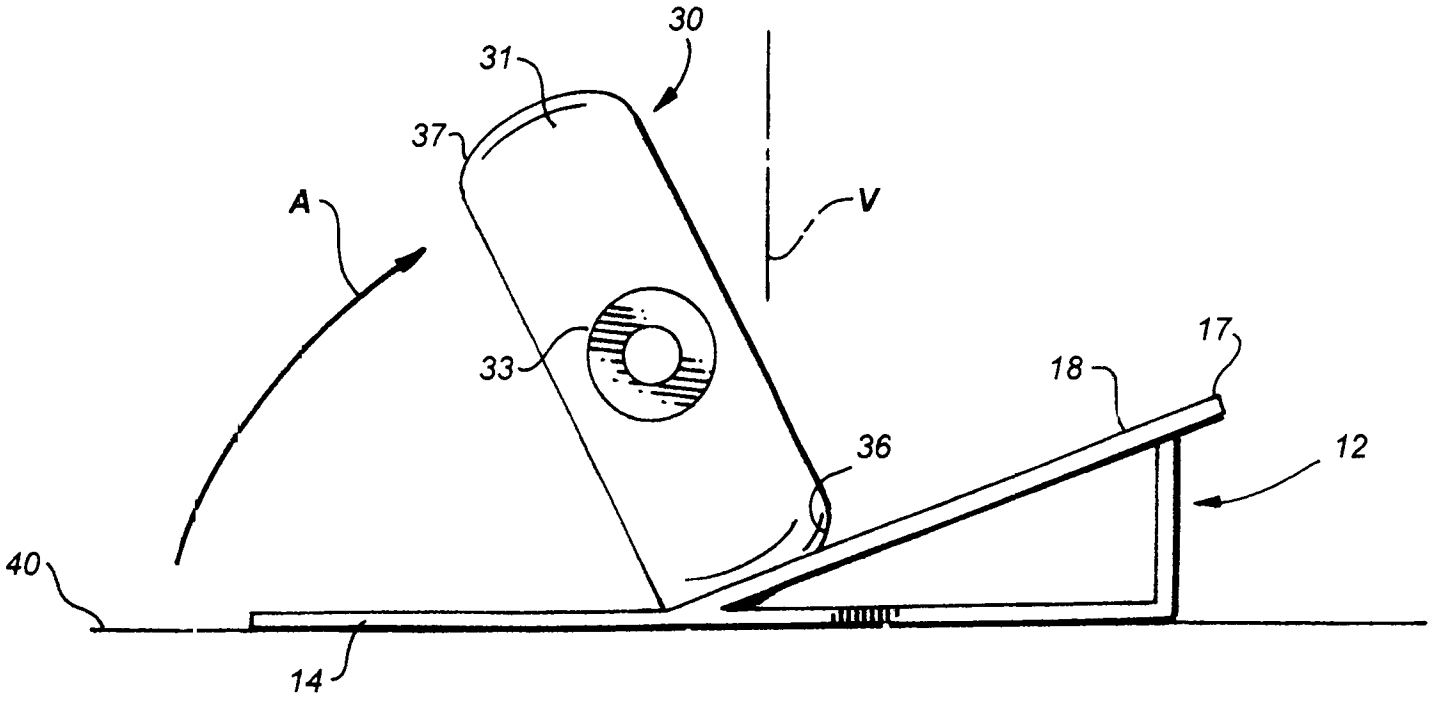
FIG. 2 is a side elevation view illustrating the mode of operation of the exercise apparatus of FIG. 1.

In use, as would be appreciated by those of skill in the art, tire 31 must be pushed past vertical axis V (FIG. 3) so that gravity can produce a horizontal vector X of sufficient magnitude to overcome the frictional resistance between side 36 and ground 40 and cause apparatus 30 to roll down surfaces 16 and 18. In FIG. 2, tire 31 has not yet been pushed past axis V. In FIG. 3, tire 31 has been pushed past axis V. Consequently, it is critical the wheels 33, 34 do not contact surfaces 81, 16, respectively, until after tire 31 is pushed past axis V. Further, tire 31 must be pushed far enough past axis V and surfaces 16, 18 must be sufficiently canted for the force of gravity G to produce a vector X (FIG. 3) having a magnitude sufficient to overcome the frictional resistance between side 36 and ground 40 and to make tire 31 roll down surface 16, 18 to return to a desired starting position like the starting positions illustrated in FIGS. 1 and 4. In FIG. 2, tire 31 is, of course, canted in a direction different from and opposite the direction in which tire 31 is canted in FIG. 3.

In one preferred embodiment of the invention, a guidance apparatus is utilized. One such apparatus is illustrated in part in ghost outline in FIG. 1 and includes an elongate arm 50 and a U-shaped track 51. As is further depicted in FIG. 5, the upper end 56 of arm 50 includes an aperture 57 through which one end of axle 32 rotatably extends. End 56 is, as depicted in FIG. 1, positioned intermediate wheel 33 and one side of tire 31. A second arm and track 51A would also be utilized adjacent base member 13, and the upper end of such a second arm would be positioned intermediate wheel 34 and the other side of tire 31. The other end of axle 32 would rotatably extend through an aperture in the second arm comparable to aperture 56. The second arm would generally remain parallel to arm 50 during operation of the apparatus. The second track 51A would be parallel to track 51 and to members 13 and 14. Consequently, both arm-track combinations would function to maintain axle 32 normal to members 13 and 14 and to tracks 51, 51A during operation of the exercise apparatus of the invention.

Figure 5:
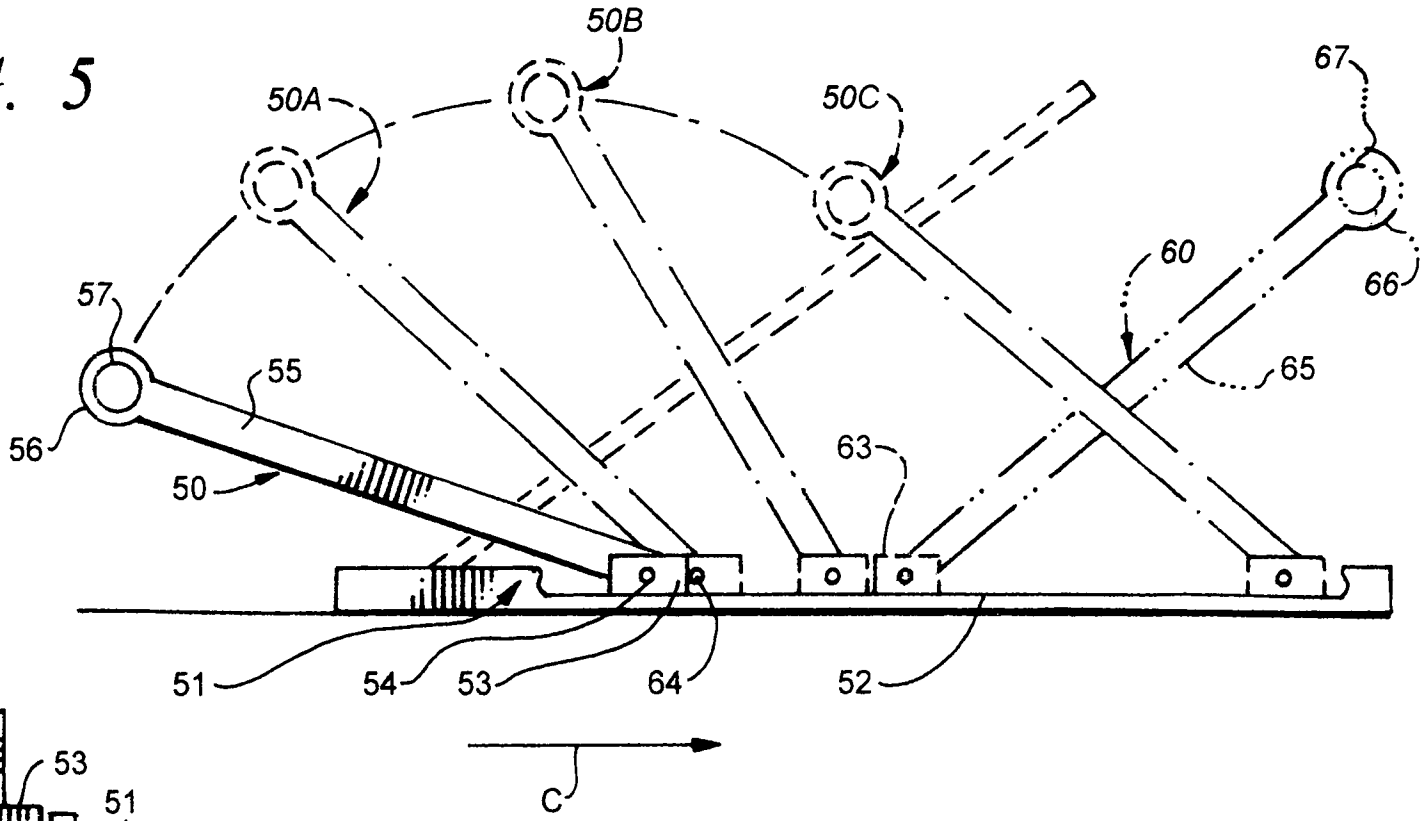
FIG. 5 is a side elevation view illustrating the mode of operation of a tracking system which can be utilized in the invention.
Figure 6:
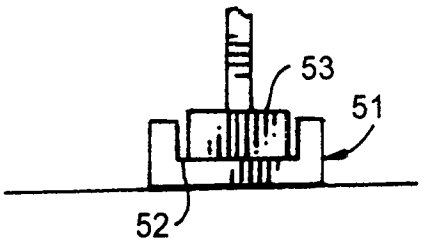
FIG. 6 is an end view of a portion of the tracking system further illustrating a rail and tracking foot utilized in the tracking system.

In FIG. 5, tire 31, axle 32, and wheels 33, 34 are omitted for sake of clarity. Arm 50 is shown in a starting position comparable to where arm 50 would be when tire apparatus 30 is in the position illustrated in FIG. 1. When an individual picks up tire 31 at side 37 and lifts and pushes tire 31 to the position shown in FIG. 3, arm 50 moves sequentially through the positions illustrated in ghost outlines 50A, 50B, and 50C. When arm 50 is in the position illustrated by ghost outline 50C, tire 31 is in the position shown in FIG. 3. The lower end of arm 50 is pivotally attached 54 to a foot 53 which slides along the bottom 52 of the groove formed in U-shaped rail 51 (FIG. 6). After tire 31 reaches the position shown in FIG. 3, wheels 33 and 34 roll down surfaces 16 and 18 to return tire apparatus 30 to a position comparable to that shown in FIG. 1. When tire apparatus 30 rolls back down surfaces 16 and 18, arm 50 and foot 53 "retrace" their steps and move sequentially through positions indicated by ghost outlines 50B and 50A and back to the original starting position of arm 50 and foot 53 illustrated in FIGS. 1 and 5. If desired, foot 53 can be replaced by a wheel or some other construct which rolls or moves along the groove formed in rail 51. The shape and dimension and structure of guidance apparatus utilized to insure the wheels 33, 34 roll down (and not off) surfaces 18, 16, respectively, can be varied as desired.

In one embodiment of the invention, tire apparatus 30 does not have the starting position illustrated in FIG. 1. In FIG. 1, tire 31 lays on and contacts the ground 40. In contrast, in FIG. 4 tire 31 has a starting position in which it is oriented parallel to and spaced apart from the ground. In this embodiment of the invention, a stop can be inserted in each rail 51, 51A so that foot 53 can only move back, for example, to the position occupied by foot 53 when arm 50 is in the position illustrated by ghost outline 50A. This prevents tire apparatus 30 from returning to the original position depicted in FIG. 1, and only permits tire apparatus to return to a position in which tire 31 can be oriented parallel to and spaced apart from the ground in the manner illustrated in FIG. 4.

Another embodiment of the invention is illustrated in FIG. 7 and includes the apparatus of FIG. 1 in conjunction with a mirror image apparatus comprising tire apparatus 30A, tire 31A, ramps 15A and 17A, inclined surfaces 16A and 18A, axle 32A, and wheels 33A and 34A. The mirror image apparatus would include a guidance apparatus comparable to that described above for tire apparatus 30. In order to save space, tire apparatus 30 and mirror image tire apparatus 30A can, if desired, be moved closer together and use the same guide rails 51, 51A. The limitation in such an arrangement is that tire apparatus 30 must be used at a different time than tire apparatus 30A because otherwise (if tires 31 and 31A were being lifted simultaneously), as would be appreciated by those of skill in the art, the feet 53 on the arms 50 of tire apparatus 30 would slide along rails 51 and 51A into and contact the feet on the arms 50 of tire apparatus 30A. If tire apparatus 30 is instead used while tire 31A remains in the position shown in FIG. 7, then the feet 53 on the arms 50 of tire apparatus 30 can, when tire 31 is in the position shown in FIG. 3, be in positions along rails 51 and 51A which are close to but do not contact the feet 53 of the arms 50 on tire apparatus 30A. After, however, tire 31 has moved back to the position illustrated in FIG. 1, the feet on the arms 50 of tire apparatus 30 have withdrawn sufficiently along rails 51 and 51A for the feet on arms 50 of tire apparatus 30A to move—when tire 31A is lifted—freely along rails 51 and 51A toward apparatus 30 without contacting the feet 53 of the arms 50 on tire apparatus 30.

Another embodiment of the exercise machine of the invention is illustrated in FIGS. 9 to 13. This embodiment enables an individual to lift, or flip a tire from a starting position. After the tire is lifted, the machine returns the tire to the starting position after the tire is lifted through an arc of only about 90 degrees.

As shown in FIGS. 9 to 13, the exercise machine includes a spaced apart parallel pair of rigid rails, or rods, 110 and 111 fixedly removably mounted to a floor. Spacing between the rails 110, 111 can be maintained by one or more spacer bars 150 which interconnect and are perpendicular to each rail 110, 111. A pair of elongate, straight substantially rigid upstanding arms 112 and 113 each have a lower end pivotally affixed to a rail 111 and 110, respectively. Pliable straps 119 and 122 each have an end affixed to arm 112 and another end affixed to rail 111. Pliable straps 120 and 121 each have an end affixed to arm 113 and another end affixed to rail 110.

Figure 9:
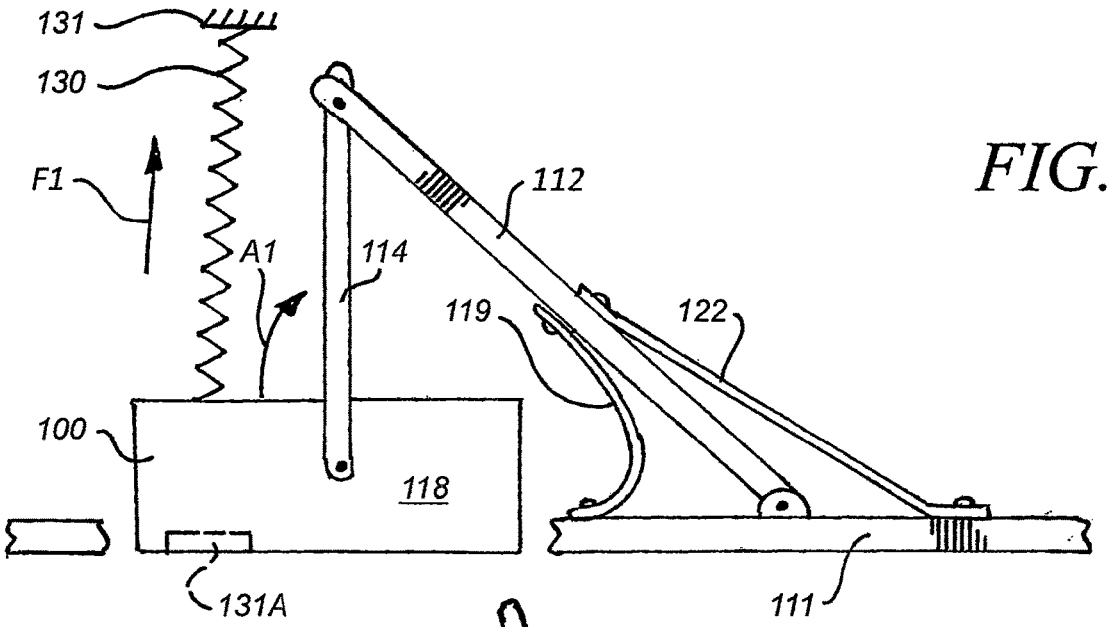
FIG. 9 is a side view illustrating an alternate embodiment of the invention.

Elongate rigid arm 114 has a first upper end pivotally affixed to the upper end of arm 112, as shown in FIG. 9. The lower end of arm 114 is pivotally connected to tire 118 by member 117.

Elongate rigid arm 115 has a first upper end pivotally affixed to the upper end of arm 113. The lower end of arm 115 is pivotally connected to tire 118 by member 116 (FIG. 13).

Figure 11:
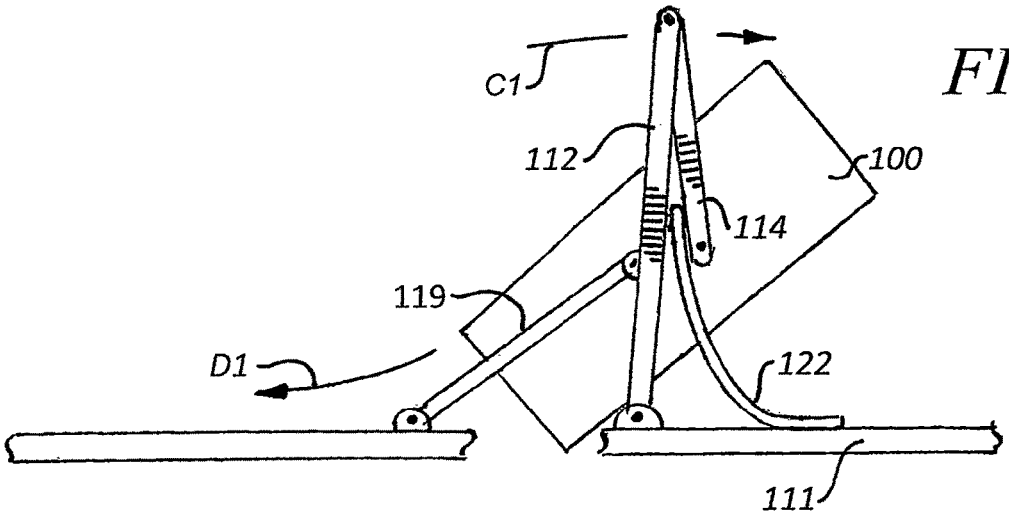
FIG. 11 is a side view of the apparatus of FIG. 9 further illustrating the mode of operation thereof.
Figure 12:
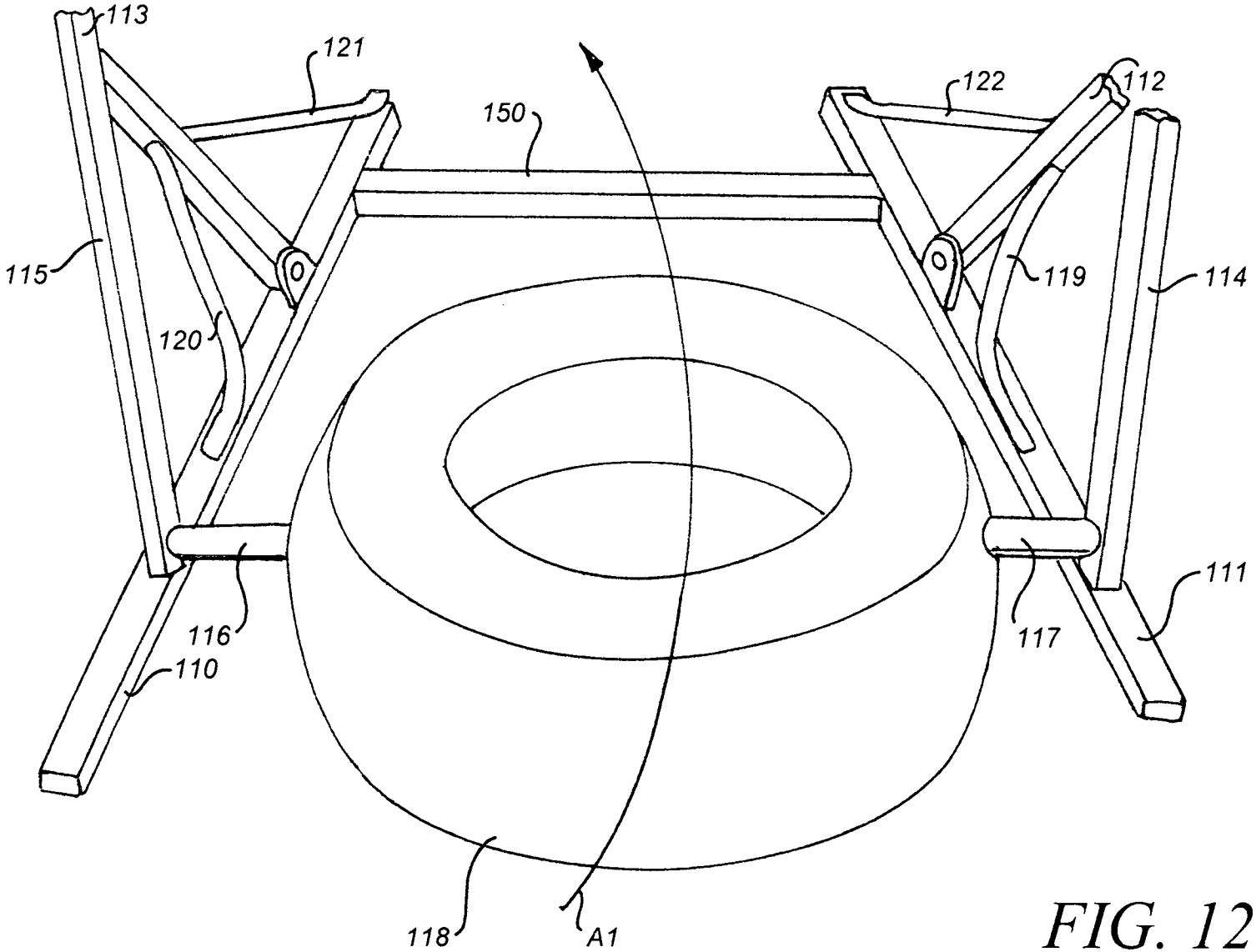
FIG. 12 is a front perspective view of the apparatus of FIG. 9 further illustrating the mode of operation thereof; and, FIG. 13 is a front perspective view of the apparatus of FIG. 9 further illustrating the mode of operation thereof.

The starting position of tire 118 is illustrated in FIGS. 9 and 12. Tire 118 lies in a horizontal orientation flat on the ground. The end 100 of tire 118 furthest from strap 122 is lifted by an individual in the direction of arrow A1 in FIG. 9. As tire 118 continues to be pivotally lifted and moved upwardly in the direction of arrow A1, and then in the direction of arrow B1 (FIG. 10), the tire 118 reaches the position illustrated in FIG. 10. The tire 118 continues to be lifted, or pushed, in the direction of arrow C1 in FIG. 11, which causes the lower end of tire 118 to slid along (or move above) the ground in the direction of arrow D1 (FIG. 11) until tire 118 returns to its original horizontal orientation and position illustrated in FIG. 9. When tire 118 returns to its original horizontal orientation, arms 112 to 115 also return to the original position illustrated in FIGS. 9 and 12.

Figure 10:
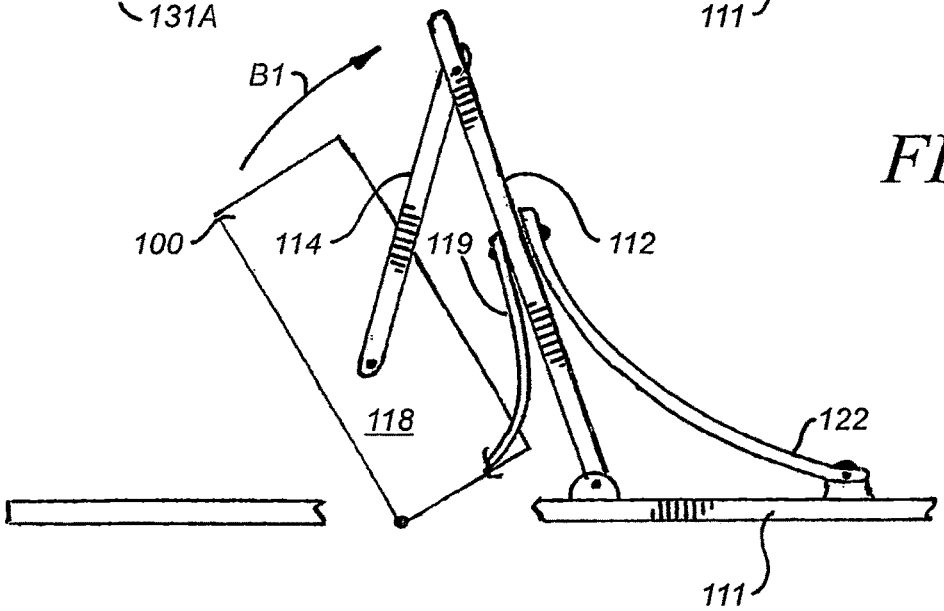
FIG. 10 is a side view of the apparatus of FIG. 9 illustrating the mode of operation thereof.

In FIG. 9, strap 122 is fully extended and tensioned to hold bar 112 in the position shown. In FIGS. 9 and 10, strap 119 is limp and not tensioned. When, however, end 100 of tire 118 is lifted upwardly in the direction of arrows A1 and B1, strap 122 becomes limp in the manner shown in FIG. 10, and strap 119 begins to straighten and become tensioned. When end 100 of tire 118 moves in the direction of arrow C1 in FIG. 11 and "tips over" and begins to move downwardly, strap 119 (and strap 120 in FIG. 9) becomes tensioned and fully extended to maintain arm 112 (and 113) in the vertical position illustrated in FIG. 11. End 100 continues to move downwardly, and tire 118 (and arms 112, 113 and arms 114 and 115) returns to the position illustrated in FIGS. 9 and 12.

Figure 13:
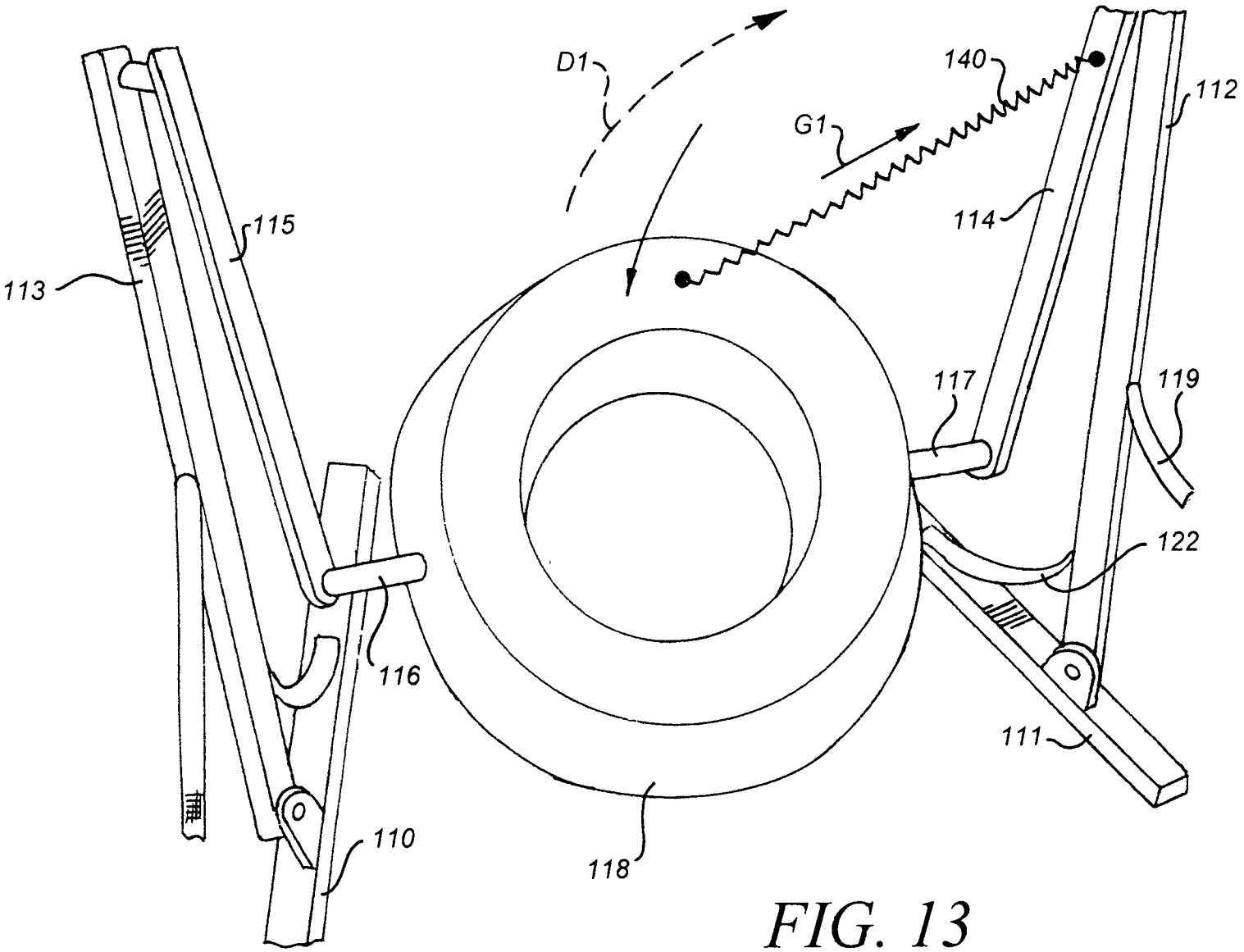

The position of tire 118 in FIG. 11 is comparable to the position of tire 118 in FIG. 13.

If desired, a spring 130 can be attached at one end to tire 118 and at the other end to a desired structure or anchor point 131 so that the spring 130 generates a force F which functions to apply a lifting force to end 100 when tire 118 is in the horizontal orientation illustrated in FIG. 9.

A spacer or expanding spring 131A can be placed under tire 118 to lift end 100 slightly off the ground so that a user can more readily grasp end 100 when lifting tire 118 from the horizontal orientation of FIG. 9.

In FIG. 13, spring 140 interconnects tire 118 and arm 114 (or arm 112) and generates a force in the direction of arrow G1 when tire is in the position illustrated in FIGS. 11 and 13, or, when the tire is upright or vertical and is between the positions shown in FIGS. 10 and 11. Consequently, spring 140 or some other desired system can be utilized to prevent tire 118 from going past "vertical" so that tire 118 is, in use, simply lifted from the horizontal orientation or position of FIG. 9 to a generally vertical position and then reverses direction and returns to the position of FIG. 9 (a) without moving past "vertical" to the position of FIG. 11, and (b) without moving past "vertical" in the directions indicated by arrows C1 and D1 to return to the position of FIG. 9. Consequently, when tire 118 is lifted from its horizontal orientation on the ground or floor in the direction of arrows A1 and B1 to a generally vertical orientation, spring 140 functions to help stop movement of tire 118 in the direction of arrow B1, and, to pull tire 118 in a direction opposite that of arrow B1 so that the tire returns to the horizontal orientation illustrated in FIG. 9.

FIG. 9 illustrates the apparatus in a first operative position in which tire 118 is in a generally horizontal orientation on the ground, in which arm 114 (and 115) is generally vertically oriented, and in which arm 112 (and 113) is canted. In FIG. 9, tire 118 is beneath arms 112 and 113, but is not positioned between arms 112 and 113.

FIG. 10 illustrates the apparatus in a second operative position in which tire 118 is canted in a first direction (i.e., canted downwardly toward the right), in which arm 114 (and 115) is generally vertically oriented, and in which arm 112 (and 113) is also generally vertically oriented. In FIG. 10 tire 118 is not between arms 112 and 113 but is positioned forwardly (or to the left) of arms 112 and 113. In FIG. 10, the ground, or floor, functions as a fulcrum about which tire 118 pivots when tire 118 is lifted in the manner indicated by arrows A1 and B1.

FIG. 11 illustrates the apparatus in a second operative position in which tire 118 is canted in a second direction (i.e., canted downwardly toward the left), in which arm 114 (and 115) has partially passed between and is positioned between arms 112 (and 113), in which arms 112 to 115 each are generally vertically oriented, and in which tire 118 is positioned between arms 112 to 115. In FIG. 11, tire 118 has begun moving in the direction of arrow D1 back to the position illustrated in FIG. 9. And, when tire 118 moves in the direction of arrow D1 back to the position shown in FIG. 1, arms 112 to 115 pivotally move to the left back to the position shown in FIG. 9. Arms 112 to 115 are shaped and dimensioned such that tire 118 can be pivoted in the manner illustrated in FIGS. 9 to 13. The permits an individual to pick up end or side 100, move end 100 in the direction of A1, B1, and C1. Once tire 118 is pivoted to the position shown in FIG. 11, the force of gravity acting on tire 118 causes the tire to move in the direction indicated by arrow D1. Arms 112 to 115 are shaped and dimensioned such that tire 118 and arms 112 to 115 can pivotally move in the manner indicated in FIGS. 9 to 13.

Having described my invention and presently preferred embodiments thereof, I claim:

1. Exercise apparatus comprising (a) a tire having an outer diameter and first and second opposed sides;

(b) support apparatus contacting and upwardly depending from the ground and comprising (i) a generally horizontally oriented base contacting the ground, and (ii) first and second arms pivotally connected to and upwardly extending from said base, spaced apart a selected distance greater than said diameter of said tire, each having first and second ends, (iii) a third arm with a first end pivotally connected to said first end of said first arm, and a second end pivotally connected to said first side of said tire, (iv) a fourth arm with a first end pivotally connected to said first end of said second arm, and a second end pivotally connected to said second side of said tire, said support apparatus and said ground having a support apparatus-ground interface;

said support apparatus being shaped and dimensioned such that said tire is movable between at least three operative positions (c) a first operative position in which (i) said tire is generally horizontally oriented with respect to the ground, (i) said third arm is generally vertically oriented, and (ii) said first arm is canted with said first end of said first arm spaced apart from and positioned above said tire, and said second end of said first arm positioned below said first end of said third arm and first end of said first arm, (iii) said tire is generally horizontally oriented with respect to the ground, positioned between said third and fourth arms, positioned beneath said first and second arms, and not positioned between said first and second arms, (d) a second operative position in which (i) said first arm pivots upwardly to a first generally vertical orientation, (ii) said third and fourth arms move upwardly to a first generally vertical orientation, (iii) said tire is canted in a first direction and generally vertically oriented with respect to the ground, pivoted about a fulcrum comprising the ground, positioned between said third and fourth arms, positioned forwardly from said first and second arms, and not positioned between said first and second arms, (e) a third operative position in which (i) said first and second arms pivot to a second generally vertical orientation, (ii) said third and fourth arms pivot between said first and second arms to a second generally vertical orientation, (iii) said tire is canted in a second direction opposite said first direction, generally vertically oriented with respect to the ground, positioned between said third and fourth arms, and positioned between said first and second arms.

* * * * *